US006932502B2

(12) United States Patent
Childers et al.

(10) Patent No.: US 6,932,502 B2
(45) Date of Patent: Aug. 23, 2005

(54) MIXING APPARATUS

(75) Inventors: Winthrop D. Childers, San Diego, CA (US); Mark A. Van Veen, Cardiff by the Sea, CA (US); Mohammad M Samii, La Jolla, CA (US); Steven W Steinfield, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 282 days.

(21) Appl. No.: 10/137,817

(22) Filed: May 1, 2002

(65) Prior Publication Data

US 2003/0206484 A1 Nov. 6, 2003

(51) Int. Cl.[7] ..... B01F 15/02

(52) U.S. Cl. ..... 366/152.1; 366/173.1; 366/177.1; 366/182.1

(58) Field of Search ..... 366/154.4, 173.1, 366/177.1, 182.1, 181.6, 153.1, 153.2, 152.1, 181.1

(56) References Cited

U.S. PATENT DOCUMENTS 4,403,866 A * 9/1983 Falcoff et al. ..... 366/152.1
4,621,927 A * 11/1986 Hiroi ..... 366/152.1
4,646,222 A * 2/1987 Okado et al. ..... 363/56.05
5,388,906 A * 2/1995 Rao ..... 366/173.2
5,402,162 A 3/1995 Fusting et al.
5,580,168 A * 12/1996 Alireza et al. ..... 366/153.1
5,604,519 A 2/1997 Keefe et al. ..... 347/13
5,666,145 A 9/1997 Hayes et al.
6,112,605 A * 9/2000 Papen et al. ..... 73/864.22
6,123,735 A 9/2000 Raghavan et al.
6,368,562 B1 4/2002 Yao
6,394,575 B1 5/2002 Kent
6,478,414 B2 * 11/2002 Jeanmaire ..... 347/77
6,513,901 B1 * 2/2003 Walker ..... 347/19
2002/0197733 A1 * 12/2002 Bohm et al. ..... 422/100

FOREIGN PATENT DOCUMENTS

FR 2 622 471 A1 5/1989
GB 2 097 692 A 11/1982

* cited by examiner

*Primary Examiner*—Tony G. Soohoo

(57) ABSTRACT

A mixing apparatus that includes a drop on demand fluid dispenser for adding an additive fluid to a receiver liquid to produce a composite liquid that includes the receiver liquid and the additive fluid.

14 Claims, 3 Drawing Sheets

MIXING APPARATUS

BACKGROUND OF THE DISCLOSURE

Liquids are combined or mixed in many industrial processes. For example, liquids are mixed in the manufacture of products such as chemicals, medications, detergents, paints, and integrated circuits. Liquids are also mixed in treating water for human consumption, or for use in manufacturing. Liquids are mixed for example by pumping one liquid into a container that contains another liquid. It is often difficult to control the amount of a second liquid that is being added to a first liquid.

BRIEF DESCRIPTION OF THE DRAWINGS

Advantages and features of the disclosure will readily be appreciated by persons skilled in the art from the following detailed description when read in conjunction with the drawing wherein.

DETAILED DESCRIPTION OF THE DISCLOSURE

Figure 1:
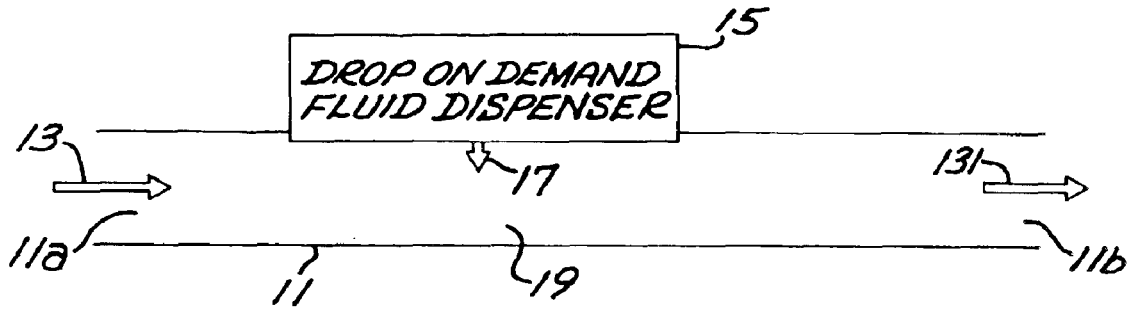
FIG. 1 is a schematic block diagram of an embodiment of a mixing apparatus that employs a drop on demand fluid dispenser.

FIG. 1 is a schematic block diagram of an embodiment of a mixing system that includes a conduit or channel 11 that guides a flow or stream of a receiver or base liquid 13 from an input 11*a* toward an output 11*b*. A drop on demand fluid adder or dispenser 15 controllably adds an additive fluid 17 to the flowing base liquid 13 at a combining junction 19 of the channel 11 to produce a composite liquid 131. The additive fluid can be a mixture or combination of a plurality of component additive fluids.

Figure 2:
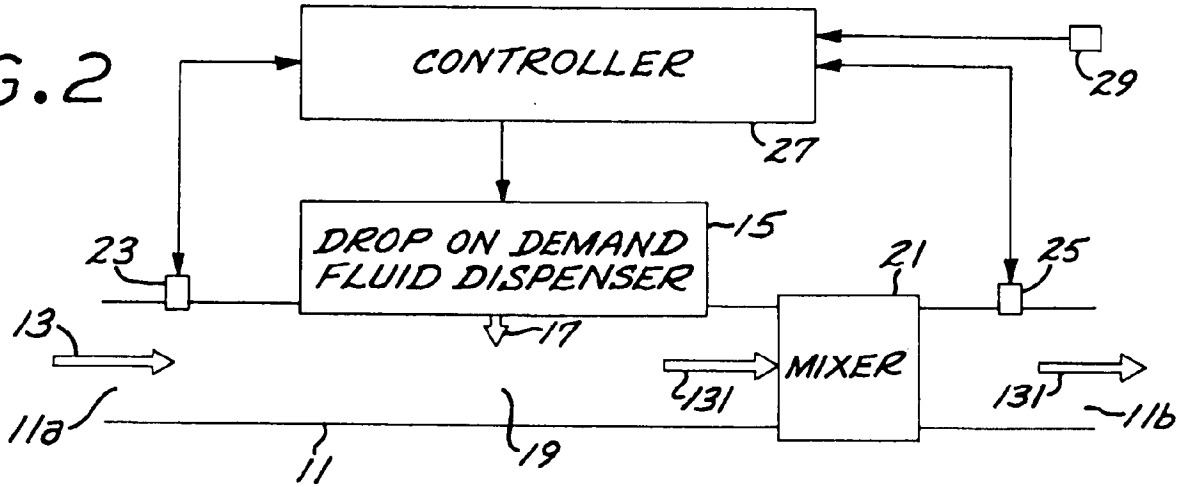
FIG. 2 is a schematic block diagram of a further embodiment of a mixing apparatus that employs a drop on demand fluid dispenser.

FIG. 2 is a schematic block diagram of another embodiment of a mixing system that includes a conduit or channel 11 that guides a flow or stream of a receiver or base liquid 13 from an input 11*a* toward an output 11*b*. A drop on demand fluid adder or dispenser 15 controllably adds an additive fluid 17 to the flowing base liquid 13 at a combining junction 19 of the channel 11 to produce a composite liquid 131. The additive fluid can be a mixture or combination of a plurality of component additive fluids. A mixer 21 can be employed to further mix the additive fluid 17 into the base liquid 13. An input sensor 23 can be employed to sense or detect one or more parameters or characteristics of the base liquid 13 before the additive fluid 17 is introduced, for example by sampling the base liquid 13 at a location upstream of the junction 19. An output sensor 25 can be employed to sense or detect one or more parameters or characteristics of the composite liquid 131, for example by sampling the composite liquid 131 at a location downstream of the combining junction 19

A controller 27 controls the operation of the drop on demand fluid dispenser 15, for example to control the amount of additive fluid 17 that is added to the base liquid 13. The operation of the drop on demand fluid dispenser 15 can be adjusted in response to the output of the input sensor 23 and/or the output of the output sensor 25.

For example, the parameters or characteristics that can be detected by the input and/or output sensor(s) 23, 25 can be one or both of two types: (1) characteristics of the base liquid or the composite liquid that are affected by the additive fluid component(s), and/or (2) characteristics of the composite liquid that are indicative of the concentration of the additive fluid component(s). Specific examples of parameters or characteristics that can be detected or sensed include resistivity, ion count, pH, surface tension, bacteria count, and colorimetry. Also, the input and/or output sensor (s) 23, 25 can be volumetric or flow rate sensors that measure how much liquid is passing through the mixing apparatus.

The system of FIG. 2 can also have a reference detector or sensor 29 for sensing parameters or characteristics of a reference object or thing whose sensed parameters or characteristics are used to control the operation of the drop on demand fluid dispenser 15 For example, the reference sensor 29 can be colorimetric sensor that senses the color of a color sample that is to be paint matched.

Figure 3:
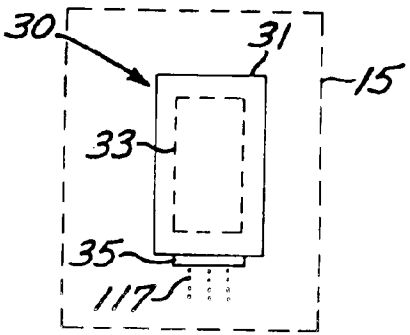
FIG. 3 is schematic block diagram of an embodiment of a drop on demand fluid dispenser.

Referring now to FIG. 3, an embodiment of the drop on demand fluid dispenser 15 can comprise a fluid drop emitting device 30 that emit drops of an additive fluid component 117 into the base liquid 13. The additive fluid component 117 forms the additive fluid 17. The drop emitting device 30 includes a body 31, an on-board fluid reservoir 33 in the body 31 that holds an amount of an additive fluid, and a drop on demand fluid drop emitter structure 35 that is supported or housed by the body 31. The drop on demand fluid drop emitter structure 35 can be a plurality of electrically addressable fluid drop generators that are selectively controlled by control signals provided by the controller 27 to emit drops of an additive fluid component 117. The fluid drop emitter structure 35 can comprise for example a thermal drop emitter structure or a piezoelectric drop emitter structure similar to thermal or piezoelectric ink drop emitting printheads employed in ink jet printers.

A suitable thermal drop on demand drop emitter structure can include, for example, an array of nozzles or openings in an orifice structure that is attached to or integral with a fluid barrier structure that in turn is attached to a thin film substructure that implements drop firing heater resistors and apparatus for enabling the resistors. The fluid barrier structure can define fluid flow control structures, particle filtering structures, fluid passageways or channels, and fluid chambers. The fluid chambers are disposed over associated fluid drop firing resistors, and the nozzles in the orifice structure are aligned with associated fluid chambers, such that thermal drop generators are formed of respectively associated heater resistors, fluid chambers and nozzles. To emit a fluid drop, a selected heater resistor is energized with electric current. The heater resistor produces heat that heats fluid in the adjacent fluid chamber. When the fluid in the chamber reaches vaporization, a rapidly expanding vapor front forces fluid within the fluid chamber through an adjacent orifice. An example of a thermal drop on demand drop emitter structure employed in thermal ink jet printing can be found in commonly assigned U.S. Pat. No. 5,604,519.

Figure 4:
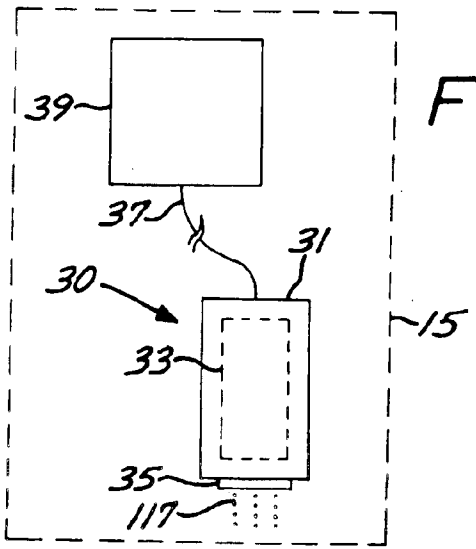
FIG. 4 is a schematic block diagram of a further embodiment of a drop on demand fluid dispenser.

The use of a drop on demand fluid drop emitter structure can provide for accurate volumetric fluid dispensing, for example in a closed loop system wherein the operation of the drop on demand fluid drop emitter structure is controlled pursuant to information provided by an input sensor, an output sensor and/or a reference sensor FIG. 4 is a schematic block diagram of an embodiment of a drop on demand fluid dispenser 15 that includes a drop emitting device 30 like the fluid drop emitting device 30 of the embodiment of a drop on demand fluid dispenser shown in FIG. 3. The fluid drop emitting device 30 receives additive fluid from a fluid reservoir 39 that is off-axis, separate or remote from the fluid drop emitting device 30 and is fluidically connected by a conduit 37 to the on-board reservoir 33 of the fluid drop emitting device 30. The off-axis fluid reservoir 39 can be pressurized, and can be replaceable separately from the fluid drop emitting device 30.

Figure 5:
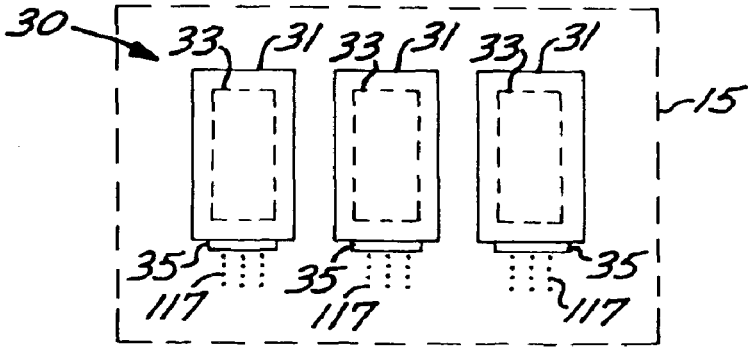
FIG. 5 is a schematic block diagram of another embodiment of a drop on demand fluid dispenser

FIG. 5 is a schematic block diagram of an embodiment of drop on demand fluid dispenser 15 that includes a plurality of fluid drop emitting devices 30, each of which can be like the fluid drop emitting device 30 of the embodiment of a drop on demand fluid dispenser shown in FIG. 3. Each of the drop emitting devices 30 can emit drops of the same additive fluid component 117 as any other drop emitting device, or it can emit drops of a different additive fluid component. The additive fluid components 117 together form the additive fluid 17 (FIG. 1). One or more of the fluid emitting device 30 can be fluidically connected to a respective off-axis reservoir like the fluid drop emitting device 30 of the embodiment of a drop on demand fluid dispenser shown in FIG. 4.

Figure 6:
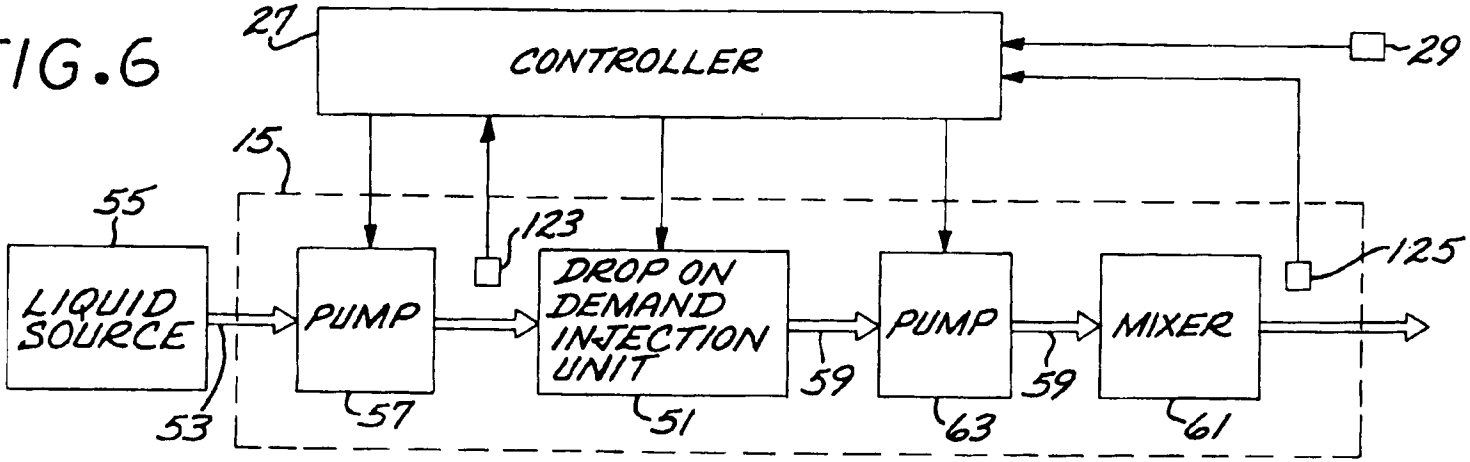
FIG. 6 is a schematic block diagram of an embodiment of a micro mixer that can be employed as a drop on demand fluid dispenser.

FIG. 6 is a schematic diagram of an embodiment of a micro mixer that can be employed as the drop on demand fluid dispenser 15 of FIG. 1. The micro mixer 15 includes a drop on demand fluid drop injection module 51 that receives a flow or stream of a receiver or carrier liquid 53 from a liquid source 55, for example via an input pump 57. The carrier liquid 53 can comprise the same liquid as the base liquid 13. The injection module 51 emits drops of an additive fluid into the carrier liquid 53 to form a liquid mixture 59. An output pump 63 can be employed to move the liquid mixture 59, and a mixer 61 can be employed to further mix the liquid mixture 59. The liquid mixture 59 provided by the micro mixer 15 comprises the additive fluid 17 (FIG. 1).

An input sensor 123 can be employed to sense or detect one or more parameters or characteristics of the carrier liquid 53 at the input to the drop on demand injection unit, and an output sensor 125 can be employed to sense or detect one or more parameters or characteristics of the liquid mixture 59. Specific examples of parameters or characteristics that can be detected or sensed include resistivity, ion count, pH, surface tension, bacteria count, and colorimetry. Also, the input and/or output sensor(s) 123, 125 can be volumetric or flow rate sensors that measure how much liquid is passing through the mixing apparatus. The outputs of the input sensor 123 and the output sensor 125 are provided to the controller 27 which controls the drop on demand injection module 51 and can also control the pumps 57, 63. The operation of the drop on demand injection module can be adjusted in response to the output or outputs of any input sensor 23 (FIG. 2), output sensor 25 (FIG. 2), reference sensor 29 (FIG. 2), input sensor 123 and/or output sensor 125 that may be employed.

Figure 7:
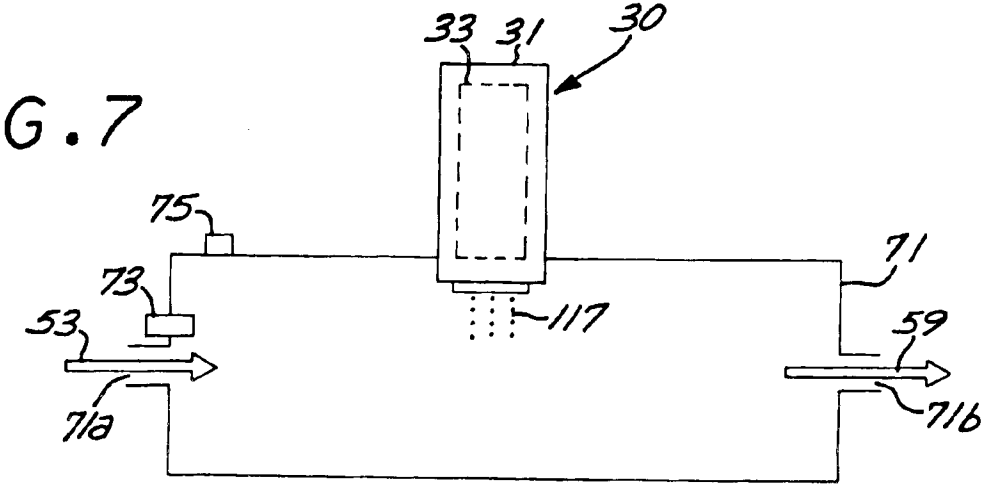
FIG. 7 is a schematic block diagram of an embodiment of the drop on demand injection module of the micro mixer of FIG. 6.

FIG. 7 is a schematic diagram of an illustrative embodiment of the injection module 51 of the micro mixer of FIG. 6. The injection module includes a channel 71 having an inlet 71*a* and an outlet 71*b*. The channel 71 guides a flow or stream of the carrier liquid 53 from the inlet 71*a* towards the outlet 71*b*, and a drop emitting device 30 emits drops of an additive fluid component 117 into the body of carrier liquid 53 in the channel 71. The drop emitting device 30 can be like the drop emitting device 30 of the embodiment of a drop on demand fluid dispenser shown in FIG. 3, and can be fluidically connected to an off-axis reservoir like the drop emitting device 30 of the embodiment of a drop on demand fluid dispenser shown in FIG. 4. Also, a plurality of drop emitting devices 30 can be employed like in the embodiment of a drop on demand fluid dispenser shown in FIG. 5. The level of liquid in the channel 71 can be controlled for example to maintain a desired spacing between the liquid in the channel and the drop emitter structures 35. For example, a liquid level sensor 73 can generate a signal that is used by the controller to control liquid level by controlling the respective liquid transfer rates of the input pump 57 and the output pump 61. As another example, air can be controllably introduced into the channel 71 or controllably removed from the channel 71 via an air vent 75 such that the air pressure level inside the channel 71 controls and maintains a desired liquid level.

Mixing apparatus in accordance with the disclosure can be employed in variety of applications in which a relatively small and controlled amount of an additive fluid is added to a base, receiver or carrier liquid. The mixing apparatus can be particularly useful in applications where extremely high dilution requirements are present and/or the additive must be added precisely as a function of the amount of liquid passing through the mixing apparatus and/or the micromixer.

One example of an application that can employ mixing apparatus in accordance with the disclosure is paint mixing. In such application, the base liquid 13 can be a paint base and the additive fluid 17 comprises one or more colorants such as cyan, yellow, magenta, red, green, blue, orange, for example. The final color can be controlled by real-time colorimetric analysis of the composite liquid and control of the amounts of component additive fluids added. A continuous range of output paint colors can be achieved. The use of drop on demand drop emitting apparatus allows for a wide range of paint colors and accurate control of color.

An illustrative example of paint mixing is making white paints of different shades that are generated by slight differences in colorant additives. By utilizing drop on demand drop emitting apparatus, the amount of each colorant added can be controlled continuously between picoliter amounts and multiple milliliter amounts, for example.

As another example of paint mixing, mixing apparatus in accordance with the disclosure can be employed in a paint gun of a painting system that includes a colorimetric sensor. The colorimetric sensor can be used to detect the color of an area to be matched, and the controller appropriately adjusts the colorants added to a white base paint to produce a matching paint spray output.

Another application that can employ mixing apparatus in accordance with the disclosure is water treatment wherein the drop on demand fluid drop emitter devices emit drops of materials such as water treatment chemicals, biocides, beneficial bacteria, or surfactants. For example, such water treatment would be useful for treating the water supply of a laboratory or a semiconductor fabrication facility where closed loop monitoring of the incoming water supply can be important. As another example, the disclosed mixing apparatus can be used to treat drinking water with very low dosage additives.

The addition of biocides in water treatment can involve very high dilution ratios, and by way of illustrative example the biocide ratio can be varied in response to the bacteria count or trend in bacteria count detected by an input detector that monitors bacteria count. As another example, an output detector that monitors the resultant biocide content can be employed to control the amount of biocide that is added.

The addition of surfactant in water treatment can involve precise control of the amount of surfactant added, for example if the desired surface tension is on a steep part of the curve of surface tension versus surfactant addition. An output detector that monitors the surface tension of the composite liquid can be employed to control the amount of surfactant added.

Another application that can employ mixing apparatus in accordance with the disclosure is adding a radioactive or other tracer to effluent or waste water that is to be treated or collected. Detection of the trace in a stream or other body of water would be indicative of contamination by the effluent or waste water. In this manner, the addition of a radioactive or other tracer to effluent or waste water can be utilized to encourage compliance with waste handling regulations. The use of the disclosed mixing apparatus allows for extremely high dilution ratios, which is particularly useful when employing radioactive tracers. The controller 27 in conjunction with an output sensor and/or an input sensor can determine how much tracer has been added, for example by calculation based on liquid flow rate or measuring the presence of tracer, or both, as a cross-check.

Mixing apparatus in accordance with the disclosure can also be employed in the manufacture of liquid pharmaceuticals. In such application, the drop on demand fluid drop emitting apparatus can be utilized to add biologically active materials to the base liquid 13.

As another example, mixing apparatus in accordance with the disclosure can be employed in a drug delivery system such as an intravenous delivery system wherein one or more drugs are added to a liquid. A plurality of drugs can be delivered simultaneously, and the quantity of each drug can be controlled over a large dynamic range.

More generally, mixing apparatus in accordance with the disclosure can be employed in applications that involve mixing of component fluids, for example wherein one or more of the components comprises a relatively small portion of a desired composite liquid.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A mixing apparatus for mixing a receiver liquid and an additive fluid, comprising:

a channel for guiding a stream of the receiver liquid; and a plurality of drop on demand drop generators for adding the additive fluid to the receiver liquid so as to produce a composite liquid that includes the receiver liquid and the additive fluid, an output sensor for sensing a characteristic of the composite liquid; and a controller responsive to said output sensor for controlling said plurality of drop on demand drop generators.

2. The mixing apparatus of claim 1, wherein the plurality of drop on demand drop generators includes an off-axis reservoir for containing the additive fluid.

3. The mixing apparatus of claim 1, wherein each of the plurality of drop on demand drop generators is electrically addressable.

4. The mixing apparatus of claim 1, wherein the output sensor comprises a color sensor.

5. The mixing apparatus of claim 1, wherein the output sensor comprises a flow rate sensor.

6. The mixing apparatus of claim 1 further comprising:

an input sensor for sensing a characteristic of the receiver liquid; and a controller responsive to the input sensor for controlling the plurality of drop on demand drop generators.

7. The mixing apparatus of claim 1 further including a pump for pumping the receiver liquid into the channel.

8. A mixing apparatus for mixing a receiver liquid and an additive fluid, comprising:

a channel for guiding a stream of the receiver liquid; and a plurality of drop on demand drop generators for adding the additive fluid to the receiver liquid so as to produce a composite liquid that includes the receiver liquid and the additive fluid;

an input sensor for sensing a characteristic of the receiver liquid; and a controller responsive to said input sensor for controlling said plurality of drop on demand drop generators.

9. The mixing apparatus of claim 8, wherein the plurality of drop on demand drop generators includes an off-axis reservoir for containing the additive fluid.

10. The mixing apparatus of claim 8, wherein each of the plurality of drop on demand drop generators is electrically addressable.

11. The mixing apparatus of claim 8, further comprising a color sensor at an output of the mixing apparatus.

12. The mixing apparatus of claim 8, further comprising a flow rate sensor at an output of the mixing apparatus.

13. The mixing apparatus of claim 8, further including a pump for pumping the receiver liquid into the channel.

14. A mixing apparatus for mixing a receiver liquid and an additive fluid, comprising:

a channel for guiding a stream of the receiver liquid; and a plurality of drop on demand drop generators for adding the additive fluid to the receiver liquid so as to produce a composite liquid that includes the receiver liquid and the additive fluid;

a reference sensor for sensing a characteristic of a reference; and a controller responsive to said reference sensor for controlling said plurality of drop on demand drop generators.

* * * * *